United States Patent [19]

Fredrickson

[11] 4,371,085

[45] Feb. 1, 1983

[54] DISPLAY RACK

[75] Inventor: Howard J. Fredrickson, Cannon Falls, Minn.

[73] Assignee: Cornelius Cannon, Inc., Cannon Falls, Minn.

[21] Appl. No.: 171,132

[22] Filed: Jul. 22, 1980

[51] Int. Cl.[3] ..... A47F 5/13

[52] U.S. Cl. ..... 211/149; 108/115; 211/186

[58] Field of Search ..... 211/149, 150, 195, 200, 211/193, 186, 187, 132, 130; 108/108, 115, 111

[56] References Cited

U.S. PATENT DOCUMENTS

| | | | |
|---|---|---|---|
| 1,805,989 | 5/1931 | Levene . | |
| 2,525,405 | 10/1950 | Freirtag | 211/149 X |
| 2,693,884 | 11/1954 | Gurries | 211/136 |
| 2,788,949 | 4/1957 | Gurries . | |
| 2,803,351 | 8/1957 | Van Wiggeren | 211/136 |
| 2,956,688 | 10/1960 | Galassi | 211/148 |
| 3,040,905 | 6/1962 | Gingher et al. | 211/148 |
| 3,101,681 | 8/1963 | Streater | 211/187 X |
| 3,601,256 | 8/1971 | Bowers et al. | 211/148 R |
| 3,602,159 | 8/1971 | Marschak | 108/111 |
| 3,626,870 | 12/1971 | Schild | 108/108 |
| 3,698,567 | 10/1972 | Fenwick | 211/183 |
| 3,983,822 | 10/1976 | Suttles | 108/108 |
| 4,108,085 | 8/1978 | Shepherd et al. | 108/108 |

*Primary Examiner*—Roy D. Frazier
*Assistant Examiner*—Robert W. Gibson, Jr.
*Attorney, Agent, or Firm*—Merchant, Gould, Smith, Edell, Welter & Schmidt

[57] ABSTRACT

A display rack (20) for displaying cartons of bottles or packages is disclosed. Display rack (20) is comprised of modules (22) having a bottom support panel (34) and a back support panel (36) which are pivotably attached to allow rotatable movement between a folded configuration for packaging and shipping and an upright configuration for displaying. A header assembly (30) including a shelf (32) is provided for attaching advertising materials and providing space for sample products. Guard rails (24) are attached to the outer sides (26, 28) of outer modules (22) to direct shopping carts and people away from the stacked display of consumer products.

11 Claims, 11 Drawing Figures

FIG. 1
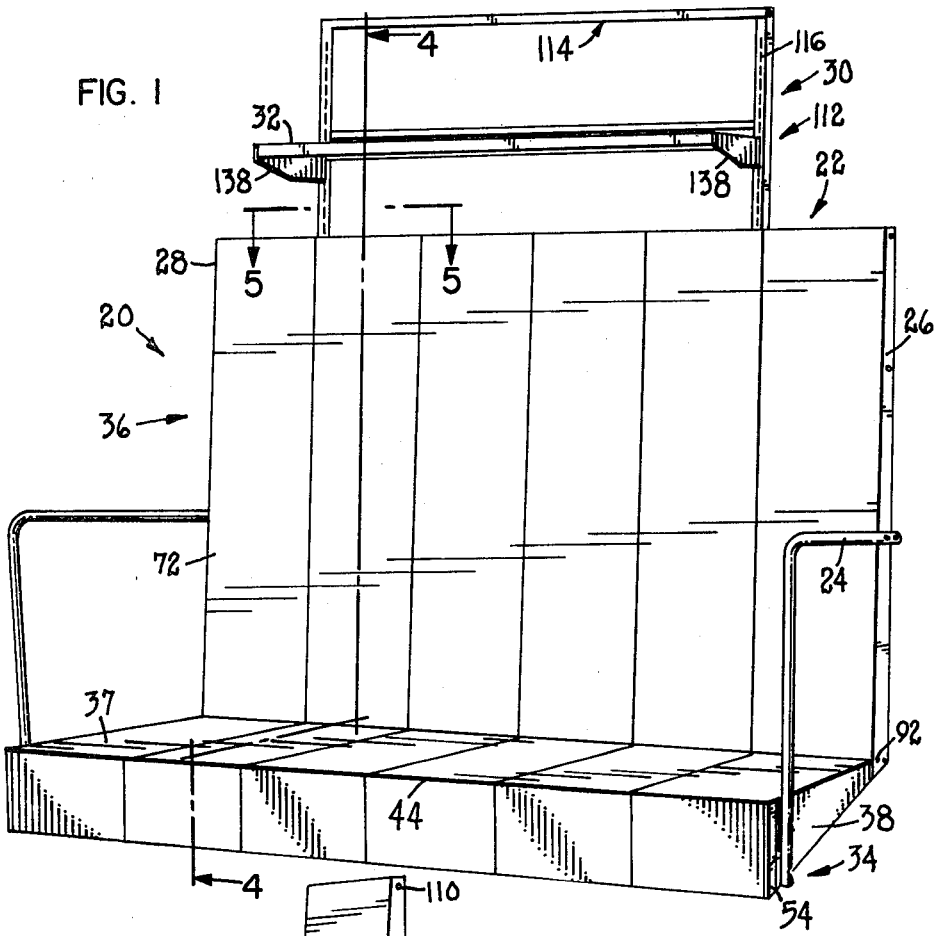
FIG. 2
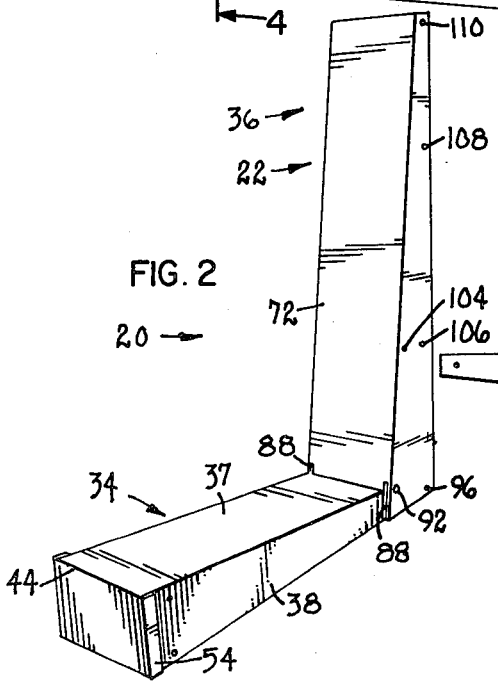
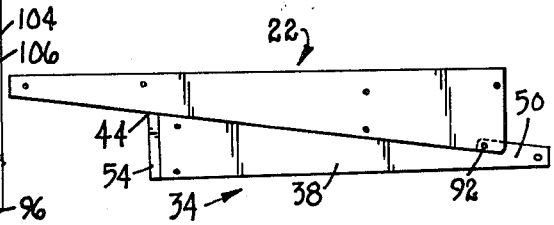
FIG. 3

FIG. 9
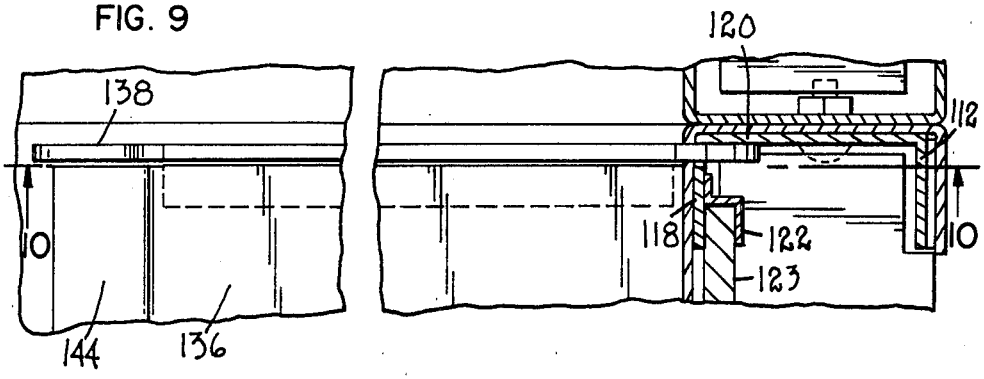
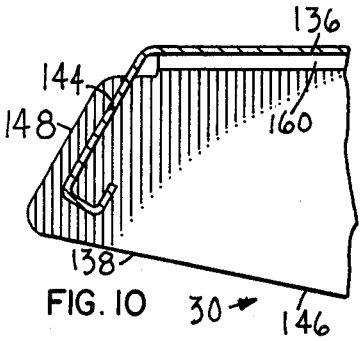
FIG. 10
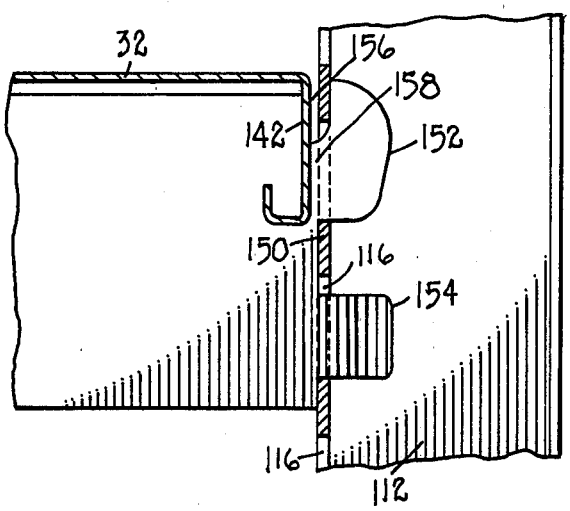
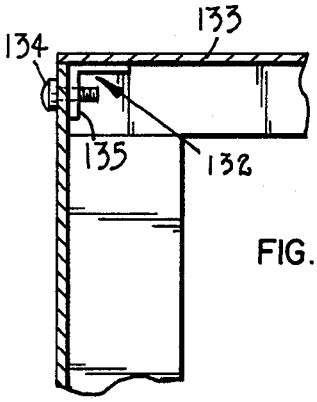
FIG. 11

DISPLAY RACK

TECHNICAL FIELD

This invention relates to display rack apparatus and, more particularly, to a display rack comprised of foldable modules for easy packaging and shipping and versatile display arrangements.

BACKGROUND OF THE INVENTION

Display racks for bottles and packages are known. Known display racks are generally ordered by a retailer or furnished by a vendor for use with a specific product. The display racks ordered by a retailer are ordinarily standard off-the-shelf items since custom-made display racks are expensive and largely limited to large retailers. Vendor furnished display racks ordinarily have standardized diminsions and often come with prepainted trademarks or advertising thereon. All display racks generally require in-store assembly. Thus, to a large extent present display racks lack versatility and are often expensive due to the singular use availabile to many of them, the custom design of some of them, and the assembly time required of practically all of them. Additionally, the standardization of the display racks often forms the basis for an undesirable display which reflects on the image of the retailer. Thus, there is a need for expanding display rack art to include new forms of versatile, yet inexpensive, display means.

SUMMARY OF THE INVENTION

The present invention is directed to a display rack for standing on a floor and holding a quantity of consumer products. The display rack is comprised of bottom support means for providing bottom support for the quantity of consumer products, back support means for providing back support for the quantity of consumer products, and means for attaching the bottom support means to the back support means. The attaching means includes means for folding the back support means with respect to the bottom support means. The folding means feature allows the bottom and back support means to be assembled and folded for convenient packaging and shipping.

In a preferred embodiment, the display rack includes a plurality of modules fastened to one another at the sides thereof with nuts and bolts. Each module includes a bottom support panel and a back support panel. The bottom support panel has a plurality of bends to integrally include an upper side for supporting the consumer products, two sidewalls extending downwardly from the upper side, flanges extending inwardly from the sidewalls, and a rear side extending downwardly from the upper side to a spaced distance from the flanges. A plurality of structural members are attached to the bottom support panel to extend between the upper side and the flanges thereby providing support for the upper side.

The back support panel also has a plurality of bends to integrally include a forward side for supportiing the consumer products, a top side, two upright sides extending rearwardly from the forward side, and a lower lip extending forwardly from the forward side and under the rear side of the bottom support panel. The lower lip is located between the rear side and the flanges of the bottom support panel so that when the consumer products are placed on the upper side of the bottom support panel, the lower lip is pinched between the rear side and the flanges of the bottom support panel. This mechanism increases the support capability of the back support panel as weight, that is, an increased number of consumer products, is added to the bottom support panel. An angle member is attached to and extends between the upright sides of the back support panel. The angle member, in conjunction with the top side of the back support panel, holds the upright sides approximately parallel. The angle member also supports the back support panel on the floor.

The back and bottom support members are fastened together along an axis approximately perpendicular to the sidewalls of the bottom support panel and the upright sides of the back support panel. The fastening mechanism is nuts and bolts. The fastening mechanism allows the back and bottom support panels to be rotated or folded relative to one another into a configuration convenient for packaging and shipping.

Guard rails are fastened to the outer sides of the outer modules. The guard rails function to protect the display from inadvertent impact with shopping carts or people. A display header is attached to extend across several modules of the display rack. The display header often includes a shelf for displaying samples of the product and a hardboard surface substantially perpendicular to the shelf for attachment or insertion of advertising material.

The present display rack is advantageously versatile because it is easily expandable to a width needed or desired by a particular retailer. The expansion is accomplished simply by adding additional modules.

Another attractive feature is the folding mechanism which allows at least two configurations. The folded configuration has the upper side of the bottom support panel and the forward side of the back support panel in planar contact. In the folded configuration, the display rack is substantially assembled, yet compactly folded for packaging and shipping. In the display configuration, the upper side of the bottom support panel and the forward side of the back support panel form a right angle to provide the necessary structure for display of consumer products.

A further advantage of the present display rack is the reduced amount of structural material required as a result of the interaction of the lower lip of the back support panel relative to the rear side and flanges of the bottom support panel. As indicated hereinbefore, the interaction results in an increasing support capability of the back support panel as weight is added to the bottom support panel.

Yet another advantage of the present invention is the complete elimination of nuts and bolts to the display surfaces of the rack.

For a better understanding of this invention, its advantages, and objects obtained by its use, however, reference should be had to the drawings which form a further part hereof, and to the accompanying discriptive matter in which there are illustrated and described preferred embodiments of the invention.

BRIEF DESCRIPTION OF THE DRAWINGS

FIG. 1 is a perspective view of a display rack in accordance with the present invention;

FIG. 2 is a perspective view of a single module;

FIG. 3 is a side view of a module in the folded configuration;

FIG. 9 is a partial top cross-sectional view of the shelf and header, taken along line 9—9 of FIG. 4;

FIG. 10 is a side cross-sectional view of the shelf, taken along line 10—10 of FIG. 9; and FIG. 11 is a detailed view of the fastening mechanism for the top channel of the header assembly.

DETAILED DESCRIPTION OF THE INVENTION

Figures 4, 5:
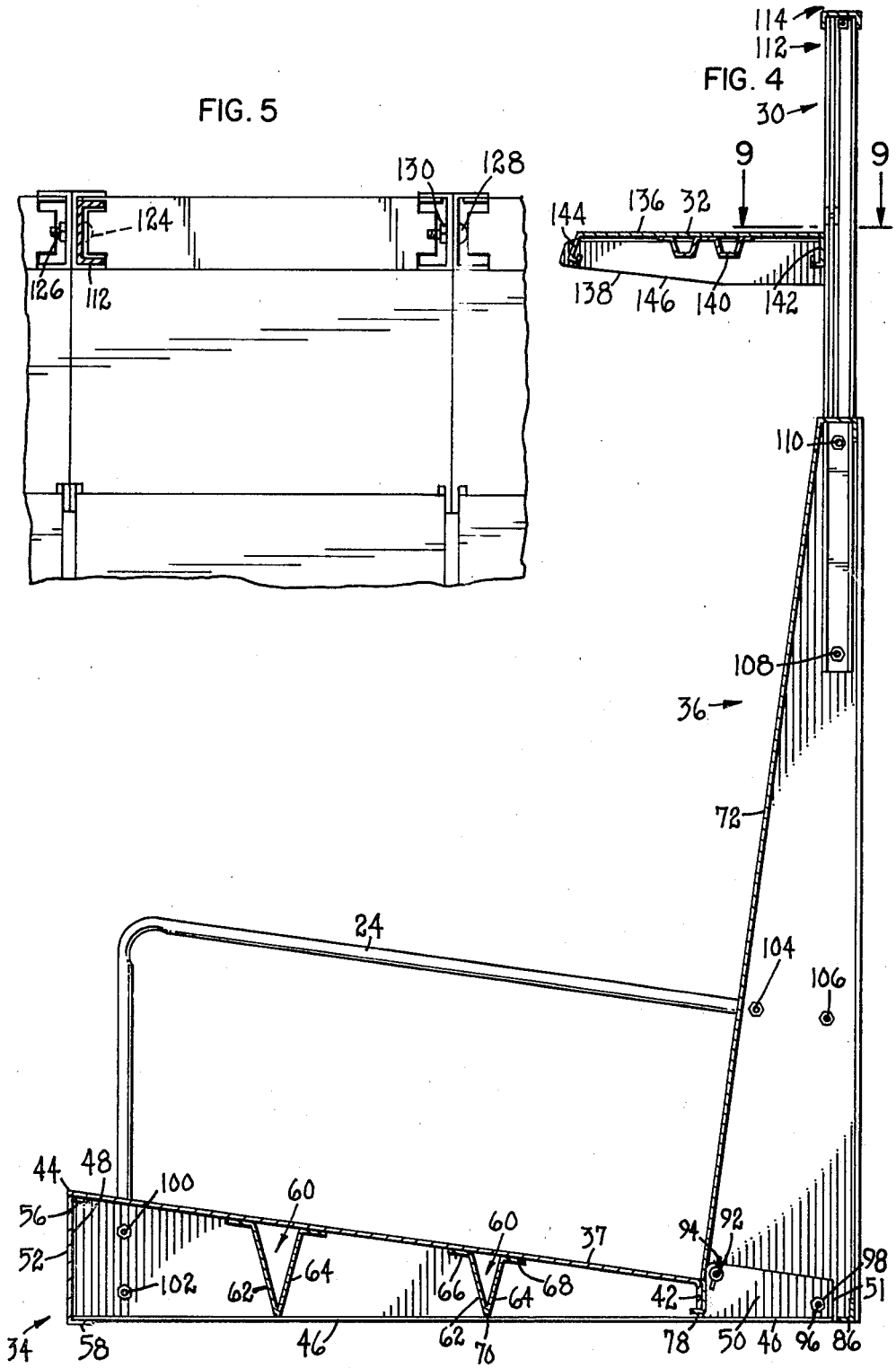
FIG. 4 is a side cross-sectional view, taken along line 4—4 of FIG. 1.
FIG. 5 is a partial top cross-sectional view, taken along line 5—5 of FIG. 1.

Referring now to the drawings wherein like reference numerals designate identical or corresponding parts throughout the several views, and more particularly to FIG. 1, a display rack in accordance with the present invention is designated generally as 20. The display rack 20 includes a plurality of modules 22. Guards 24 are fastened to the outer sides 26 and 28 of the assembly of modules 22. A header assembly 30 is fastened to two spaced-apart modules 22. Header assembly 30 includes a shelf 32 and a mechanism for holding a piece of cardboard or other material for advertising thereon.

Figure 8:
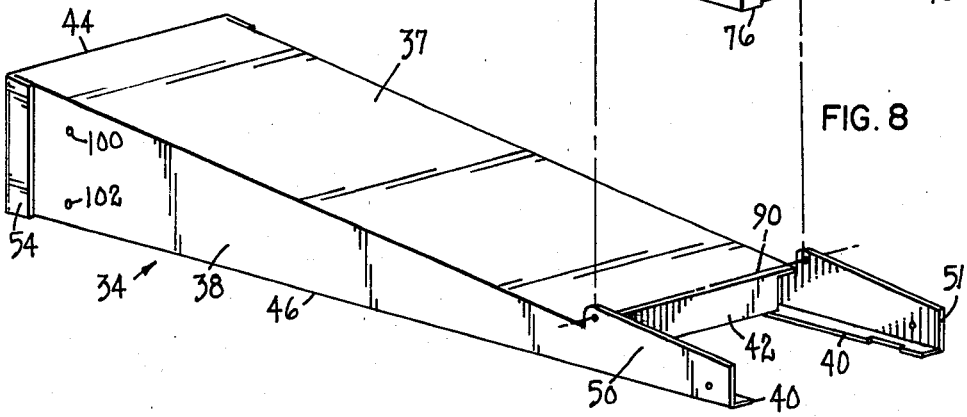
FIG. 8 is an exploded, perspective view of the bottom and back support panels.

As shown in FIG. 8, a module 22 is comprised of a bottom support panel 34 and a back support panel 36. The bottom support panel 34 has a plurality of straight bends. As an integral piece of material, bottom support panel 34 includes an upper side 37 for supporting consumer products, two sidewalls 38 extending downwardly from upper side 37, a flange 40 extending inwardly from each sidewall 38, and a rear side 42 extending downwardly from the upper side 37 to a spaced distance from flanges 40. Upper side 37 is substantially rectangular and is inclined from its forward edge 44 to rear side 42 at approximately 8° from the horizontal. The downward incline of upper side 37 gives sidewalls 38 a substantially triangular shape since the edge 46 opposite upper side 37 is substantially horizontal while the forward edge 48 is substantially vertical. The rearward ends 50 of sides 38 do not, however, end in a point. Rather, at approximately the location of rear side 42 rearward ends 50 extend upwardly to a height of approximately 1 inch greater than they would ordinarily be if sides 38 extended to the apex angle of a triangle. Rearward ends 50 have a length somewhat less than the width of the lower end of back support panel 36 and end with a vertical edge 51.

Flanges 40 extend lengthwise the entire length of sidewalls 38 and inwardly a sufficient distance to provide a stabilizing flat surface upon which bottom support panel 38 rests.

Rear side 42 has a width less than the width of upper side 36 such that before bottom support panel 34 is bent, rearward ends 50 and rear side 42 are in partial contact with one another.

A front side 52 (see FIG. 4) has a rectangular shape substantially the same as the shape defined by the forward edges of sidewalls 38, upper side 37 and the floor. Forward side 52 integrally includes flanges extending inwardly from each of its edges. The side flanges 54 (see FIG. 8) are fastened by welding or another fastening mechanism to the outer sides of sidewalls 38. Upper flange 56 is fastened similarly to the underside of upper side 37, while lower flange 58 is fastened similarly to the undersides of the forward portions of flanges 40.

As shown in FIG. 4, upper side 37 is supported in various regions along its length by a plurality of V-shaped structural members 60. The forward side 62 of structural members 60 in longer than the rearward side 64. A forward flange 66 extends forwardly from the upper edge of forward side 62, while a rearward flange 68 extends rearwardly from the upper edge of rearward side 64. Flanges 66 and 68 are inclined to match the incline of upper side 37. Structural members 60 extend between upper side 37 and flanges 40 of bottom support panel 34. Flanges 66 and 68 are attached to upper side 37 with countersunk, flat-headed, pop rivets or other fastening mechanisms which remain flush with the upper surface of upper side 37. The V-end 70 of structural members 60 is welded or otherwise fastened to flanges 40.

Back support panel 36 has a plurality of bends somewhat similar to the bends in bottom support panel 34. Back support panel 36 integrally includes a forward side 72 for providing back support for the consumer products, two upright sides 74 extending rearwardly from forward side 72, back flanges 76 extending inwardly from upright sides 74, a lip 78 (see FIG. 6) extending forwardly from the lower end of forward side 72, a top side 80 extending rearwardly from the upper end of forward side 72 and a top flange 82 extending downwardly from top side 80. Forward side 72 is substantially rectangular and inclined from the vertical approximately 8° in order to make a right angle with the upper side 37 of bottom support panel 34. Upright sides 74 are triangularly-shaped with the base edge approximately horizontal and the back edge approximately vertical. Upright sides 74 do not end in an apex angle since the upper edge is approximately parallel with and has a similar width as top side 80. Flanges 76 and 82 extend inwardly sufficiently to provide a surface with which back support panel 36 may abut a wall. The outer side of flange 82 is fastened with a weld or other fastening mechanism to the inner side of the upper portions of flanges 76. The ends of top side 80 have U-shaped slots 84 cut therein which have a function to be described hereinafter.

An angle 86 extends between the lower ends of flanges 76 having its upright side fastened thereto by a weld or other fastening mechanism. Angle member 86 holds upright sides 74 approximately parallel and helps to support back support panel 36 on the floor.

Figure 6:
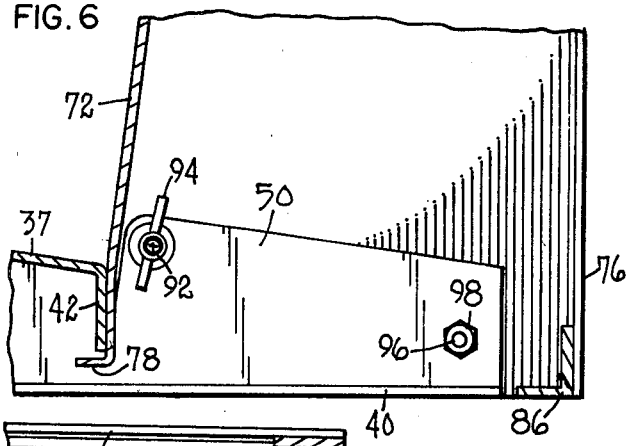
FIG. 6 is an enlarged side view of the folding mechanism and the increasing back support mechanism.
Figure 6:
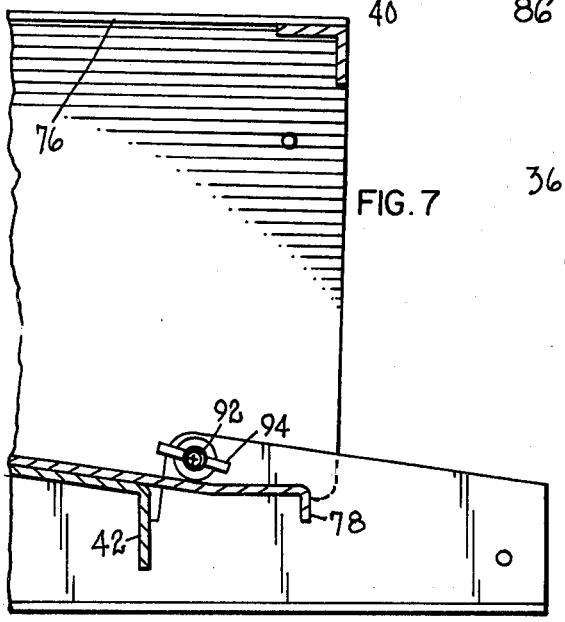

As shown in FIG. 6, the flower end of forward side 72 extends forwardly as lip 78. Lip 78 extends between rear side 42 and flanges 40 of bottom support panel 34. In this relationship, as more and more consumer products, that is, weight, are added to the rearward portion of bottom support panel 34, the lower edge of rear side 42 presses downward onto lip 78 and eventually squeezes it against flanges 40. Thus, as weight is added to the rearward portion of bottom support panel 34 the support capability of back support panel 36 increases.

Back support panel 36 is slightly wider than bottom support panel 34. A slot 88 is located along both sides of the lower portion of forward side 72 to receive ends 50 inwardly of upright sides 74.

Figure 7:
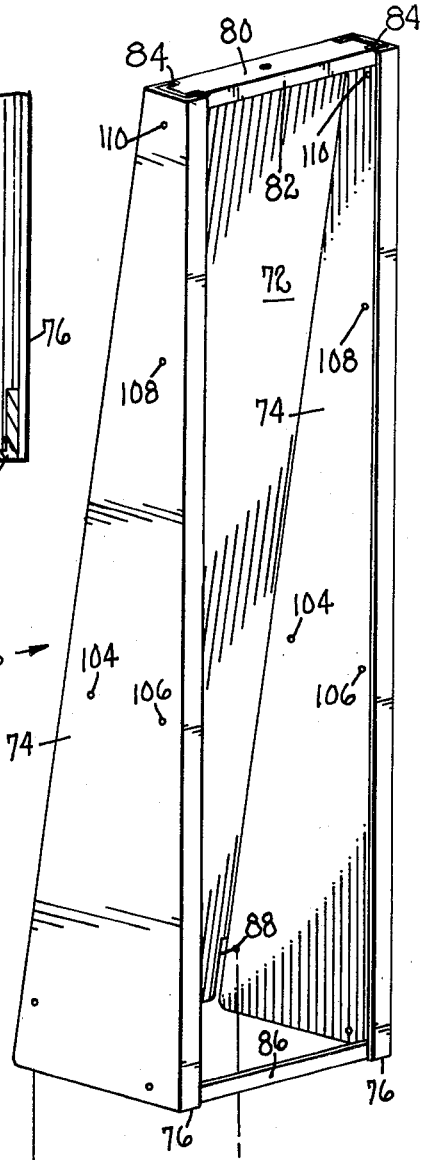
FIG. 7 is a view similar to FIG. 6 with the module shown in the folded configuration.

Back support panel 36 is pivotably attached to bottom support panel 34 along an axis 90 approximately perpendicular to sidewalls 38 and upright sides 74. The axis 90 is located near the forward and upward edges of ends 50. Axis 90 is somewhat above the upper surface of upper side 37 such that when back support panel 36 rotates downwardly the forward surface of forward side 72 and the upper surface of upper side 37 meet in planar contact as shown in FIG. 7. In this configuration, the cross-sectional area of bottom and back support panels 34 and 36 is approximately square (see FIG. 3) for convenient packaging and shipping. Bottom and back support panels 34 and 36 are pivotably attached with screws 92 and wing nuts 94 at axis 90. Bottom and back support panels 34 and 36 are fixably attached in the upright position as shown in FIG. 2 with screws and nuts 96 and 98, respectively, passing through openings toward the rear ends of rearward ends 50 and corresponding openings in upright sides 74.

A plurality of modules 22 are fastened together in the configuration of FIG. 1 with screws and nuts at a plurality of locations. Each location is also available for a fastening function different from the fastening of two modules 22 together. Two fastening locations have been previously discussed relative to screws and nuts 92–98. Two fastening locations 100 and 102 are vertically spaced near the forward portion of sidewalls 38 of bottom support panel 34. Modules fastening locations 100 and 102 are also used to attach a lower portion of the vertical leg of guard 24 to an outer side of an outer module 22 as shown in FIG. 1. Guard 24 is a tubular member bent in a substantially right angle fashion. The substantially horizontal portion of guard 24 is attached to the outer side of an outer module 22 at fastening locations 104 and 106 which are substantially horizontally spaced at an elevated height from the floor. Along inner sides of modules 22 fastening locations 104 and 106 are available to fasten modules 22 together. Finally, two vertically spaced fastening locations 108 and 110 in the upper portion of upright sides 74 are available to fasten modules 22 together or, additionally, to satisfy a secondary function described hereinafter.

Header assembly 30 is ordinarily centered on the assembly of modules 22. Header assembly 30 includes two vertical channel members 112 and a top channel member 114. Vertical channel members 112 are oppositely oriented with U-bases 120 outward. Vertical channel members 112 are inserted through U-shaped slots 84 and fastened as described hereinafter. Top channel member 114 is fastened to the top ends of channel members 112 to provide a framework. Vertical channel members 112 include a plurality of equally-spaced slots 116 (see FIGS. 1 and 10). Slots 116 are sufficiently wide and long to receive tabs 152 and 154 of shelf 32. Slots 116 are located in the forward U-leg 118 (see FIG. 9) adjacent the U-base 120 of channels 112. Holder member 122, having a Z-like shape with two staggered parallel legs and a connecting leg substantially perpendicular to both therebetween, is fastened to the inside surface of forward leg 118 by welding or another similar fastening mechanism. One edge of holder member 122 is approximately even with the edges of the U-legs of a channel member 112. The other edge of holder member 122 is approximately even with the outer-most edges of slots 116. When channel members 112 are installed, holder members 122 extend from near the top ends of channel members 112 to near the top of modules 22. A board 123 is retained between forward legs 118 and holder members 122 of channel members 112, while resting the top side 80 of back support panel 36.

Channel members 112 include vertically aligned openings to match openings in back support panel 36 at fastening locations 108 and 110 when vertical channel members 112 are installed through the U-shaped slots 84 in top side 80 of back support panel 36. As shown in FIG. 5, screws and nuts 124 and 126 are used to fasten channel member 112 and two modules 22 together at the fastening locations 108 and 110. Similarly, at fastening locations 108 and 110 where a channel member 112 is not installed, screws and nuts 128 and 130 fasten two modules together.

Top channel 114 includes an angle bracket 132 at the ends thereof. The angle brackets 132 are centered on the U-base 133 with the downward extending side 135 of brackets 132 spaced from the ends of channel member 114 a distance equal to the thickness of the base of a channel member 112. A threaded hole centered in the downward extending side 135 of angle bracket 132 is aligned with an opening in channel member 112 for passage of a fastening screw 134.

Shelf 32 is comprised of center panel 136, side panels 138 fastened at the ends of center panel 136 and a stiffening member 140 fastened longitudinally along the underside of center panel 136. As shown in FIG. 10, center panel 136 is a rectangular sheet having a right angle bend near its rearward side to form a substantially vertical wall 142 as an abutting surface with the framework of header assembly 30. The lower end of vertical wall 142 is bent forwardly in a U-shape to provide added structural strength. The forward side 144 of center panel 136 is bent downwardly at an obtuse angle ending in an inwardly U-shaped bend, again for added strength in a manner similar to vertical wall 142.

Side panels 138 are substantially rectangular with a bottom edge 146 (see FIG. 4) beginning about midway along the edge inclined slightly upward toward the front of shelf 32. The front edge 148 extends somewhat beyond the front side 144 of center panel 136 and is aligned substantially parallel with it. The rear edge 150 includes a hook tab 152 near the upper end and a straight tab 154 near the lower end. Hook tab 152 has vertical length longer than straight tab 154. A slot 156 extends downward from the upper edge of side panel 138 to make the throat 158 approximately the same dimension as the vertical length of straight tab 154. A rearward edge of slot 156 is in vertical contact with the inside surface of U-leg 118 as rear edge 150 contacts the outer surface of U-leg 118. The outside corners of hook tab 152 and straight tab 154 are rounded for easier entry into slot 116 of channel members 112. Hook tab 152 and straight tab 154 are located relative to one another such that after insertion into channel member 112, both rest substantially on the lower edges of consecutive slots 116.

An integral flange 160 extends inwardly from the upper side of side panels 138. Flange 160 is welded or otherwise attached to center panel 136.

As shown in FIG. 4, stiffening member 140 is shaped to include a plurality of longitudinally extending U-bends. The sides of stiffening member 140 are welded or otherwise fastened to the under surface of center panel 136.

To use, modules 22 are assembled in the form as shown in FIG. 2 with screws 92 and wing nuts 94 holding bottom and back support panels 34 and 36, respectively, together. Modules 22 are folded about axis 90 so that upper side 37 and forward side 72 are in planar contact as shown in FIG. 3. In this configuration, modules 22 are easily and conveniently packaged and shipped. A retailer may conveniently order as many modules as required to construct a display rack 20 to the desired or required width. The components comprising guard 24 and header assembly 30, together with fastening elements, accompany the required number of modules 22.

Upon receipt from shipment, modules 22 are unpackaged and arranged side-by-side in the configuration shown in FIG. 2. Modules 22 are fastened together with the appropriate screws and nuts at fastening locations 100–110. In addition, screws and nuts 96 and 98 are installed and wing nut 94 is tightened. Two channel members 112 are inserted through U-slots 84 in the desired spaced apart relationship. Channel members 112 are fastened with the appropriate fastening elements at fastening locations 108 and 110. Board 123 is inserted in the slot between U-legs 118 and holder members 122 of channel members 112. Board 123 rests on top side 80 of back support panel 36. Top channel member 114 is then fastened with screws 134.

Shelf 32 is installed by inclining it downward from its forward side 144 to the vertical wall 142 of its rearward side in order to insert hook tabs 152 into appropriately elevated slots 116. Shelf 32 is then pivoted downward about throats 158 of hook tabs 152 allowing straight tabs 154 to pass through the next lower slots 116 below the slots 116 into which hook tabs 152 were inserted. Shelf 32 is then allowed to rest on the lower edges of the slots 116. Guards 24 are installed with the appropriate fastening elements at fastening locations 100–106.

A retailer may then easily attach advertising materials to board 123 held by header assembly 30. Additionally, samples of the consumer product to be displayed may be placed on shelf 32. The consumer products to be displayed on display rack 20 are placed on bottom support panel 34, preferably next to back support panel 36 first with more products being added upwardly and forwardly thereafter. In this manner, weight is progressively added to the rearward portion of bottom support panel 34 thereby forcing rear side 42 downward against lips 78 as shown in FIG. 6. As more and more weight is added, lip 78 is pinched between rear side 42 and flanges 40 of bottom support panel 34. This action rigidifies and strengthens back support panel 36 thereby increasing its support capability.

Although numerous characteristics and advantages of the invention have been set forth in the foregoing description, together with details of the structure and function of the invention, it is to be understood that the disclosure is illustrative only. Any changes made, especially in matters of shape, size, and arrangement, to the full extent extended by the general meaning of the terms in which the appended claims are expressed, are within the principle of the invention.

What is claimed is:

1. A display rack for standing on a floor and holding a quantity of consumer products, comprising:

bottom support means for providing bottom support for the quantity of said products, said bottom support means including a bottom support panel having a plurality of bends, said bottom support panel including an upper side for supporting said products, two sidewalls extending downwardly from the upper side and flanges extending inwardly from the sidewalls, said bottom support means further including a plurality of structural members extending between the upper side and the flanges for supporting the upper side, said flanges contactable with the floor for supporting said bottom support means on said floor;

back support means for providing back support for the quantity of said products, said back support means including a back support panel having a plurality of bends, said back support panel including a forward side for supporting said products, two upright sides and a top side extending rearwardly from the forward side, said back support means further including an angle member extending between said upright sides, said top side and said angle member for holding said upright sides approximately parallel, said angle member also for supporting said back support means on said floor; and means for attaching said bottom support means to said back support means including means for folding said back support means with respect to said bottom support means, whereby said folding means allows said bottom and back support means to be assembled and folded for convenient packaging and shipping.

2. A display rack in accordance with claim 1 wherein said folding means includes a plurality of nuts and bolts centered on an axis passing approximately perpendicularly through the sidewalls of said bottom support panel and the upright sides of said back support panel, said nuts and bolts pivotally fastening said back support means to said bottom support means.

3. A display rack for standing on a floor and holding a quantity of consumer products, comprising:

bottom support means for providing bottom support for the quantity of said products;

back support means for providing back support for the quantity of said products;

means for attaching said bottom support means to said back support means including means for folding said back support means with respect to said bottom support means; and means for increasing the support capability of said back support means as weight applied to said bottom support means is increased, whereby said back support means provides increasingly more back support as more said products are stacked on said bottom support means, thereby increasing the weight applied.

4. A display rack for a quantity of consumer products comprising:

a plurality of modules, each said module having two sides separated by a width, each said module comprising:

bottom support means for providing bottom support for the quantity of said products, said bottom support means having two sides separated by said width;

back support means for providing back support for the quantity of said products, said back support means having two sides separated by said width;

first attaching means for attaching said bottom and back support means, the sides of said bottom and back support means being aligned to form the sides of said module;

means for increasing the support capability of said back support means as weight applied to said bottom support means is increased, whereby said back support means provides increasingly more back support as more said products are stacked on said bottom support means, thereby increasing weight applied; and second attaching means for attaching said side of one module to said side of an adjacent module;

whereby said display rack is readily expandable in width by attaching one module to another.

5. A display rack for standing on a floor and holding a quantity of consumer products, comprising:

bottom support means for providing bottom support for the quantity of said products;

back support means for providing back support for the quantity of said products supported by said bottom support means;

means for attaching said bottom support means to said back support means; and means for increasing the support capability of said back support means as weight applied to said bottom support means is increased whereby said back support means provides increasingly more back support as more said products are stacked on said bottom support means.

6. A display rack in accordance with claims 3, 4 or 5 wherein said bottom support means includes a bottom support panel having an upper side for supporting said products, wherein said back support means includes a back support panel having a forward side for supporting said products and wherein said support increasing means includes said upper side having a rearward portion bent downwardly and said forward side having a lower portion bent forwardly to extend under said rearward portion of said upper side, whereby the weight of said products on said upper side near said rearward portion causes said rearward portion to contact and press downwardly the lower portion of said forward side thereby preventing said forward side from moving rearwardly.

7. A display rack for standing on a floor and holding a quantity of consumer products, comprising:

a bottom support panel having a plurality of bends forming an upper side for supporting said products and two sidewalls extending downwardly from the upper side;

a plurality of structural members attached to said bottom support panel and extending downwardly from the upper side of said bottom support panel to support the upper side relative to the floor;

a back support panel having a plurality of bends forming a forward side for supporting said products and two upright sides extending rearwardly from the forward side;

an angle member attached to and extending between the upright sides of said back support panel both for holding the upright sides approximately parallel and for supporting said back support panel on the floor; and means for attaching said bottom support panel to said back support panel including means for folding said back support panel with respect to said bottom support panel whereby said bottom and back support panels may be assembled and folded for convenient packaging and shipping.

8. A display rack in accordance with claim 7 wherein said folding means includes means for fastening said back and bottom support means along an axis approximately perpendicular to the sidewalls of said bottom support panel and the upright sides of said back support panel, said folding means providing for first and second configurations for said display rack, the upper side of said bottom support panel and the forward side of said back support panel forming approximately a right angle in said first configuration, the upper side and the forward side being in planar contact in said second configuration, whereby said products may be displayed on said rack in said first configuration and said rack may be packaged and shipped in said second configuration.

9. A display rack in accordance with claim 7 including means for increasing the support capability of said back support panel as weight applied to said bottom support panel is increased, whereby said back support panel provides increasingly more back support as more products are stacked on said bottom support panel.

10. A display rack in accordance with claim 9 wherein said support increasing means includes the upper side of said bottom support panel having a rearward portion bent downwardly and the forward side of said back support panel having a lower portion bent forwardly to extend under the rearward portion of the upper side, whereby the weight of said products on the upper side near the rearward portion causes the rearward portion to contact and press downwardly the lower portion of the forward side thereby preventing the forward side from moving rearwardly.

11. A display rack for standing on a floor and holding a quantity of consumer products, comprising:

a plurality of modules having two sides separated by a width;

means for attaching one said side of one module to an adjacent said side of an adjacent module;

each said module comprising:

a bottom support panel integrally including an upper side for supporting said products, two sidewalls extending downwardly from said upper side, flanges extending inwardly from said sidewalls, and a rear side extending downwardly from said upper side to a spaced distance from said flanges;

a plurality of structural members attached to said bottom support panel, said structural members extending downwardly from said upper side to contact said flanges;

a back support panel integrally including a forward side for supporting said products, two upright sides extending rearwardly from said forward side, and a lower lip extending forwardly from said forward side under said rear side of said bottom support panel, said lower lip being held between said rear side and said flanges of said bottom support panel when said products are placed on said upper side of said bottom support panel;

an angle member attached to and extending between said upright sides of said back support panel both for holding said upright sides approximately parallel and for supporting said back support panel on the floor; and means for fastening said back and bottom support means along an axis approximately perpendicular to said sidewalls of said bottom support panel and said upright sides of said back support panel, said folding means providing for first and second configurations for said display rack, said upper side of said bottom support panel and said forward side of said back support panel forming approximately a right angle in said first configuration, said upper side and said forward side being in planar contact in said second configuration, whereby said products may be displayed on said rack in said first configuration and said rack may be packaged and shipped in said second configuration.

* * * * *